US009049749B2

(12) United States Patent
Huang

(10) Patent No.: US 9,049,749 B2
(45) Date of Patent: Jun. 2, 2015

(54) CRIMPING FIXED, REMOTELY REGULATED ELECTRIC HEATER

(75) Inventor: Ji Huang, Shanghai (CN)

(73) Assignee: SHANGHAI HUAZU INDUSTRY CO., LTD., Shanghai (CN)

( * ) Notice: Subject to any disclaimer, the term of this patent is extended or adjusted under 35 U.S.C. 154(b) by 786 days.

(21) Appl. No.: 13/282,934

(22) Filed: Oct. 27, 2011

(65) Prior Publication Data

US 2013/0105455 A1 May 2, 2013

(51) Int. Cl.

| | |
|---|---|
| ***H05B 1/00*** | (2006.01) |
| ***H05B 1/02*** | (2006.01) |
| ***H05B 3/24*** | (2006.01) |

(52) U.S. Cl.

CPC ..... *H05B 3/24* (2013.01); *H05B 2203/02* (2013.01); *H05B 2203/023* (2013.01)

(58) Field of Classification Search

CPC ..... H05B 3/00; H05B 1/00; H05B 3/12; E03B 3/12; E03B 7/10; E03B 7/12; A47J 31/00; B60L 1/02; F27D 11/00

USPC ..... 219/200–202, 208, 385, 504–505; 392/465–466, 468, 502; 138/32; 165/80.2–80.4

See application file for complete search history.

(56) References Cited

U.S. PATENT DOCUMENTS

| | | | | |
|---|---|---|---|---|
| 6,041,972 | A * | 3/2000 | Maayeh et al. | 222/173 |
| 2004/0112884 | A1* | 6/2004 | Uhl et al. | 219/202 |
| 2005/0092727 | A1* | 5/2005 | Fraley et al. | 219/209 |
| 2007/0045274 | A1* | 3/2007 | Lee | 219/222 |
| 2008/0135536 | A1* | 6/2008 | Kochems et al. | 219/202 |
| 2008/0203077 | A1* | 8/2008 | Brun et al. | 219/202 |
| 2009/0195989 | A1* | 8/2009 | Oda | 361/709 |

* cited by examiner

*Primary Examiner* — Dana Ross
*Assistant Examiner* — Michael LaFlame, Jr.

(57) ABSTRACT

This invention is about crimping-fixed, remotely regulated electric heater, which includes a heater tube body to hold the heating elements of PTC and heat sinks that are attached to the heater tube. The heater tube is a long strip-shaped metal tube and has flanges attached to the upper surface and lower sides of this metal tube that forms grooves at the corner between these flanges and the upper/lower surface of the metal tube body. Inside the metal tube is a cavity to hold the PTC heating element with insulation layers are applied in the cavity. Heat sink is first placed on the left and right side of the heater tube, the flanges are folded to clamp the heat sink firmly to the heater tube.

10 Claims, 5 Drawing Sheets

CRIMPING FIXED, REMOTELY REGULATED ELECTRIC HEATER

Figure 1:
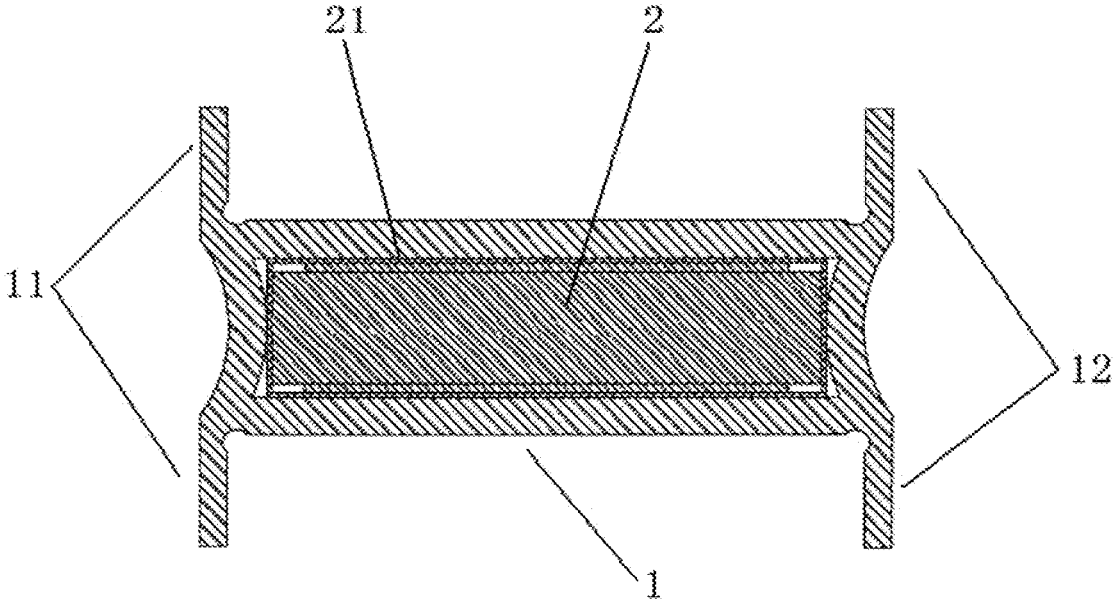

CROSS-REFERENCE TO RELATED APPLICATIONS (Not Applicable).

STATEMENT REGARDING FEDERALLY SPONSORED RESEARCH OF DEVELOPMENT (Not Applicable)

THE NAMES OF THE PARTIES TO A JOINT RESEARCH AGREEMENT (Not Applicable).

INCORPORATION-BY-REFERENCE OF MATERIAL (Not Applicable).

STATEMENT REGARDING PRIOR DISCLOSURES BY THE INVENTOR (Not Applicable).

BACKGROUND OF THE INVENTION

1. Field of the Invention

This invention is related to the field of electric heaters. Specifically, it is related to the remotely regulated heater tubes with heat sinks with flanges that are bent and folded to hold the heat sink in position.

2. Background

Heater tubes are widely used in small electric heaters, air conditioners, car heaters, air plane heaters, train heaters, marine heaters and other fields.

In the existing PTC electric heaters, the connection between the heating tubes and the heat spreading chips or plates is either by adhesive or soldering method. The use of adhesive might cause glue smell or the production of small amount of organic gas during the heating process. It might also cause connection loosening between the heating tube and the heat spreading chips after long time usage, shortening the life time of the heater. On the other hand, using soldering method often causes the production of excessive lead, which is harmful for human health.

During the installation of heater tubes, insulation paper is wound around the heating element. Currently, the way of winding is to wrap the insulation paper on the PTC heating elements layer by layer. This approach might cause the wrapping is not tightened, which causes noise when the heater is working.

This problem becomes more prominent when applied to air conditioners. With the improvement of life quality in the past several years, air conditioners become more and more popular. Heater tubes for air conditioners not only play a supporting role in providing auxiliary heating, but also help warm up coolant when the temperature is below −5 degree Celsius, so that the air conditioner could be started under low temperature. Air conditioners equipped with such heater tubes are generally used in a relatively closed space for cooling or heating. They are frequently used, and for a long time.

BRIEF SUMMARY OF THE INVENTION

The purpose of this invention is to provide crimping fixed, remotely regulated electric heater to solve the above mentioned problems.

The technical problems are solved by the following technical solutions in this invention:

Crimping-fixed, remotely regulated electric heater comprising: a heater tube body to hold the heating elements of PTC, heat spreading fin units (forming heat sink) attached to the heater tube. It is characterized by a long strip-shaped metal tube;

Flanging is made on both sides of the left surface of this metal tube;

Flanging is also made on both sides of the right surface of this metal tube;

Grooves are made at the corner between these flangings and the upper/lower surface of the metal tube body;

Inside the long-strip shaped metal tube is a cavity to hold the PTC heating element. Insulation layers are applied in the cavity to prevent the element from directly contacting the tube body.

Flanges are made at the left and right side surface of the strip-shaped long metal tube. While in use, heat sinks are attached to the upper and lower surface of the metal tube. The flanges are then bent and folded to hold the heat sink in position. Compared to the adhesive method, it avoids the problem of producing glue smell and thus reduces chemical pollution and is more environmental friendly. Meanwhile, it avoids the aging-induced glue loosing problem, and thus prolongs its life time. Compared with traditional electric heater tubes, it is more suitable for small electric heaters, air conditioners, car heaters, air plane heaters, train heaters, marine heaters, etc. Especially, its advantages become more prominent when applied for indoor air conditioning. There are at least two heat spreading fin units on each of the above mentioned heat sinks Towards to its leading edge, near the central of the fin unit, a metal sheet is bent to form a tilted angle with respect to the horizon. Towards its trailing edge is a horizontal metal sheet. The parts on both side of the tilted metal sheet are kept horizontal and work as fastening sheet.

Two adjacent fin units are firmly pressed against each other along the tilted metal sheet, forming a horizontal heat spreading structure. There are at least two fin units to form this structure. Two adjacent fin units are towards opposite directions.

The length of the fastening metal sheet is equal to the longest distance between two adjacent titled metal sheets.

The fastening metal sheets are clamped to the heater tube by the above mentioned flanges. One can also use another metal sheet as a fixation to cove the top surface of the heat sink. Flanges are made on both sides of this metal sheet. The upper fastening metal sheet is clamped to the fixation metal sheet by the two flanges. The lower fastening metal sheet is clamped to the heater tube using the flanges on both sides of the tube body.

U-shaped aluminum sheet is used to make the fixation metal sheet so that it could be fixed on the heat sink.

On both sides of the tilted metal sheet of the heat sink, two horizon metal sheets are firmly pressed together so that the U-shaped aluminum plate can be folded and fixed. In the case when there are at least two pieces of metal heat sink pressed together, as long as a loner flange set is made on one side of the U-shaped metal plate, all of the fastening metal sheets are fixed. Two flanges are used to obtain better fixation.

The PTC heating element is wrapped with insulation paper, which is a long slender strip, to prevent the heating element from directly contacting the tube body. The insulation paper is wound in a spiral way on the PTC heating element. Adjacent insulation paper layers partially overlap.

The insulating paper is wound in a spiral manner on the PTC heating element. Because the winding is in the diagonal direction, the wrapping is more tight compared to the traditional winding method. It reduces the possibility of gap generation, making is easier to put the PTC heating element into the heater cavity. Thus, it avoids the noise problem that is resulted from loose winding, and prolongs the life time of electric heaters.

Grooves are made at the corner between the flange and the electric heater tube. It facilities folding of the flanges by rolling or stamping technology. Since the groove material is thinner, it is easier to be bent, the folding is uniform and the connection is tighter.

The cross section of the groove is arc-shaped, whose radius is in the range of 0.1~0.6 mm, preferably 0.2~0.4 mm. The use of arc-shaped grooves helps the connection between the heat sink and the heater base is tighter if using rolling depression technique.

Inside the heater is a cavity which hosts the PTC heating element to heat the air.

Temperature sensor is also instrumented on the heater surface. This temperature sensor is then connected to the inlet of a remote regulation network. When heater is powered on, heat is generated in the PTC heating element, and is then transferred to the heater body. The temperature sensing device measures the heater tube temperature, and send the temperature signal to the remote regulation network. One obtains the working condition of the remote regulated heater.

The remote regulation network is connected to a power supply detection system, which is connected to the power input of the electric heater. The power detection system checks the power input, then sends the detection results to the remote regulation network. The remote regulation network is equipped with a signal processing module, which examines the data transferred from the power supply detection system, and decides whether the power input is on, if it is on, then controls the above mentioned temperature sensing devices to sense the temperature on the heater body. The temperature sensing device senses the temperature and sends the results to the signal processing module. The module examines if the temperature is in the set range, if not, indicating the heater body is working improperly. In the case of heating tube failure, air conditioner maintenance personnel are notified through the remote regulation network, timely maintenance is achieved.

The power supply detection system can be connected to a heating control system to control the heating of the electric heater. The power supply detection system detects whether the heating control system is heating the electric heater, and send the results to the input of the remote regulation network. The remote regulation network is equipped with a signal processing module, which determines if the heating control system is working properly based on the transferred data. If the heating control system is judged to be normal, the temperature sensing devices are controlled to measure the body temperature of the electric heater. The temperature signal obtained is then sent to the signal processing module to determine if the temperature is outside the set range, and thus determine if there is failure on the electric heater. Under the situation of heater body failure, air conditioner maintenance personnel are notified via remote regulation network, timely maintenance is achieved.

The above mentioned devices are connected to the remote regulation network by using wireless LAN, Bluetooth or electronic label communications.

The distance between the left surface of the long strip-shaped metal tube body to its lower surface is between 10.0 mm~30.0 mm, preferred 12.0 mm~24.0 mm; the distance between the upper and lower surface of the metal tube is between 8.0 mm~20.0 mm, preferably 8.0 mm 15.0 mm.

The wall thickness of the metal tube is between 0.5 mm~1.5 mm, preferably 0.6 mm~1.2 mm.

The insulation layer composed of insulation paper, insulate the PTC heating element t from the metal tube body.

The PTC heating element is made from ceramic. Ceramic PTC heating element is characterized with such advantages as fast heating, high thermal efficiency and low cost.

The PTC heating element can also be made from metal. Metallic PTC heating element is characterized with such advantages as fasting heating, high thermal efficiency, good stability, no power attenuation, better overloading capability.

The length of the tightening metal sheet is set to be equal to the longest distance between two adjacent tilted metal sheet, so that two adjacent fin units are connected more tightly. The heat sink thus is stronger and the life time of air conditioners is prolonged. The lower tightening metal sheet is used for clamping heat sinks directly to the electric heater tube.

This invention uses rolling or stamping technique in the production process. A whole piece of metal sheet is rolled or stamped into various connected heat spreading metal fin units. Each fin unit is one unit of the heat sink and can be seen from side as a number of ladder-shaped metal component. When the heater tube is long, one can roll and stamp fin units of appropriate length based on the heater tube length, so that it fits the heater tube length perfectly. Therefore, the use of rolling or stamping technique to make heat spreading fin unit is good for making heat sinks that match tube length, and thus can be applied to various tube lengths. Meanwhile, better size precision, stronger connection, less lead are obtained using rolling and stamping. It is environmental friendly and ensures people's health.

The width of the fastening metal sheet is equal to the half of the difference between the width of the horizontal metal sheet and the width of the tilted metal sheet.

The width of the horizontal metal sheet is 11.0 mm~20.0 mm, preferably 15.0 mm.

The width of the fastening metal sheet is 1.0 mm~4.0 mm, preferably 2.0 mm.

The length of the fastening metal sheet is 1.0 mm~5.0 mm, preferably 3.8 mm.

The angle between the horizontal metal sheet and the tilted metal sheet is 115 degrees to 125 degrees, preferably 120 degrees.

The length of the horizontal metal sheet is 1.0 mm~5.0 mm, preferably 2.2 mm.

The height of the heat sink is 5.0 mm~15.0 mm, preferably 9.0 mm, so that maximum heat transfer efficiency is obtained.

The heat sink is made from aluminum, which has good thermal conductivity and oxidation resistance. Thus, improved heat transfer efficiency and longer heat sink life of usage are obtained. The width of the insulation paper is 20 mm~100 mm, preferably 41 mm, so that the insulation paper can be easily wound on the PTC heating element.

The width of the insulation paper overlapping section is 10 mm~50 mm. Spiral wound winding is used to make the wrapping tighter, reduce gap generation and reduce the noise generation during the heating process of the electric heater.

Crimping fixed, remotely regulated electric heater include at least one heater pipe body. In reality, one can use 1 to 10 such units that are lined up to below.

The lower part of the heating tube is clamped to the fastening metal sheet of the heat sink on both sides, using its folded flanges. The heat sink is thus firmly attached to the heater tube. On the other side, the upper heater tube surface is closely clamped to the top fastening metal sheet of the heat sink, on its both sides. And so constitute a multi-row modular structure, to provide heating together and thus improve the heating capacity, which is suitable for occasions that require high heat.

BRIEF DESCRIPTION OF THE SEVERAL VIEW OF THE DRAWINGS

Figure Legend

FIG. 1 Heater tube with its flanges unfolded.

Figure 2:
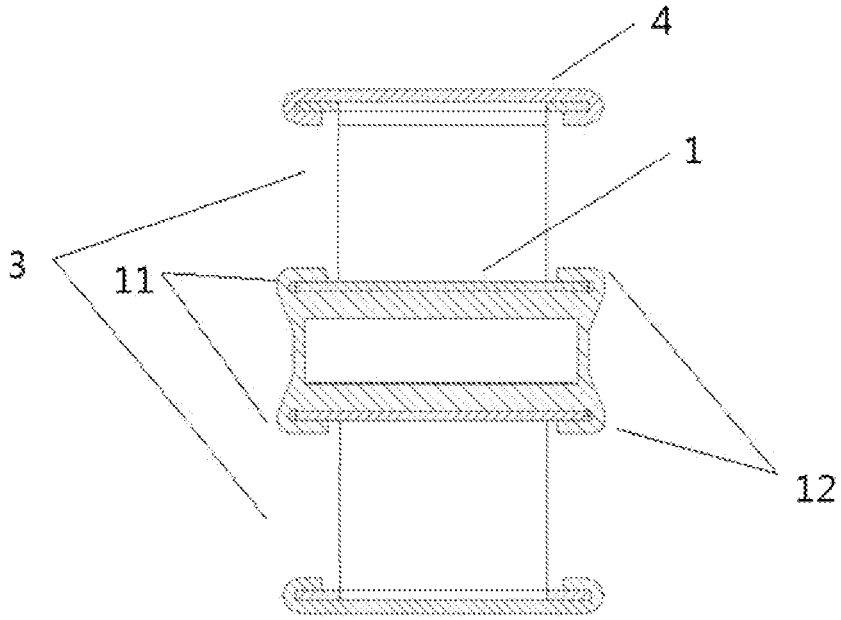

FIG. 2 Heater tube with heat sinks attached.

Figure 3:
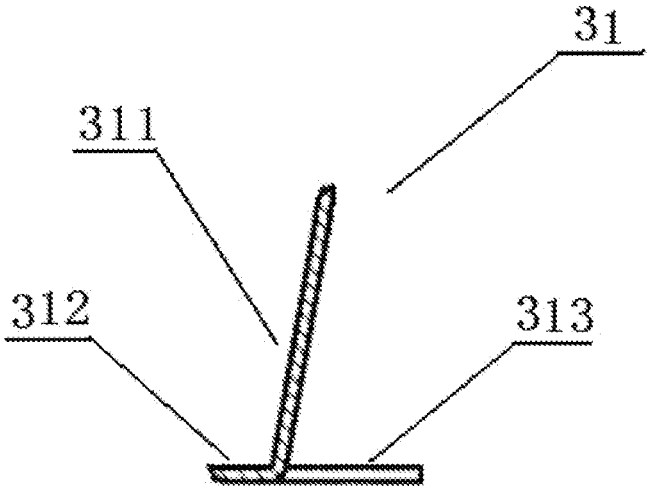

FIG. 3 Schematic diagram for a fin unit of the heat sink.

Figure 4:
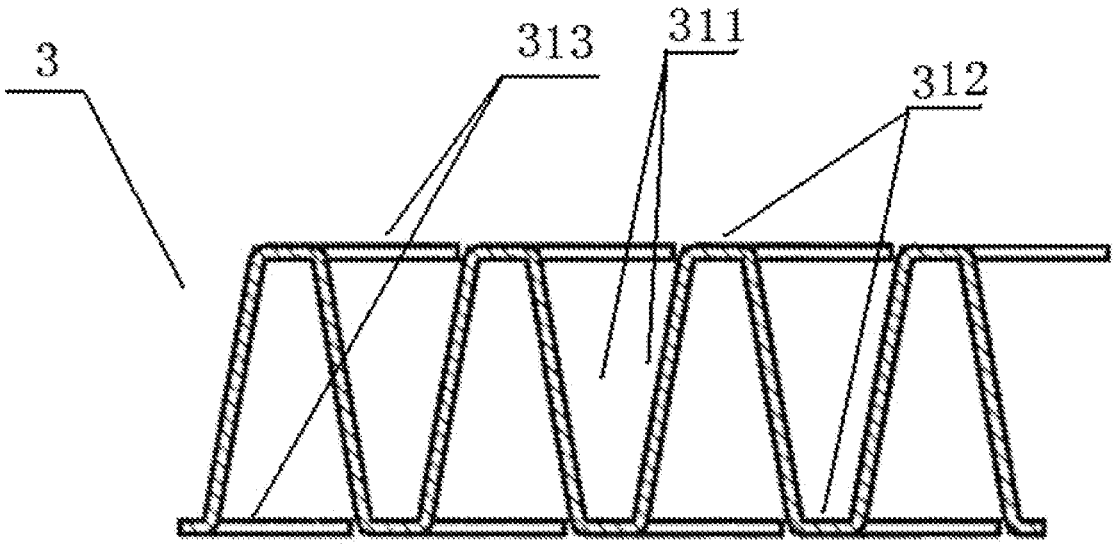

FIG. 4 Schematic diagram of heat sink structure.

Figure 5:
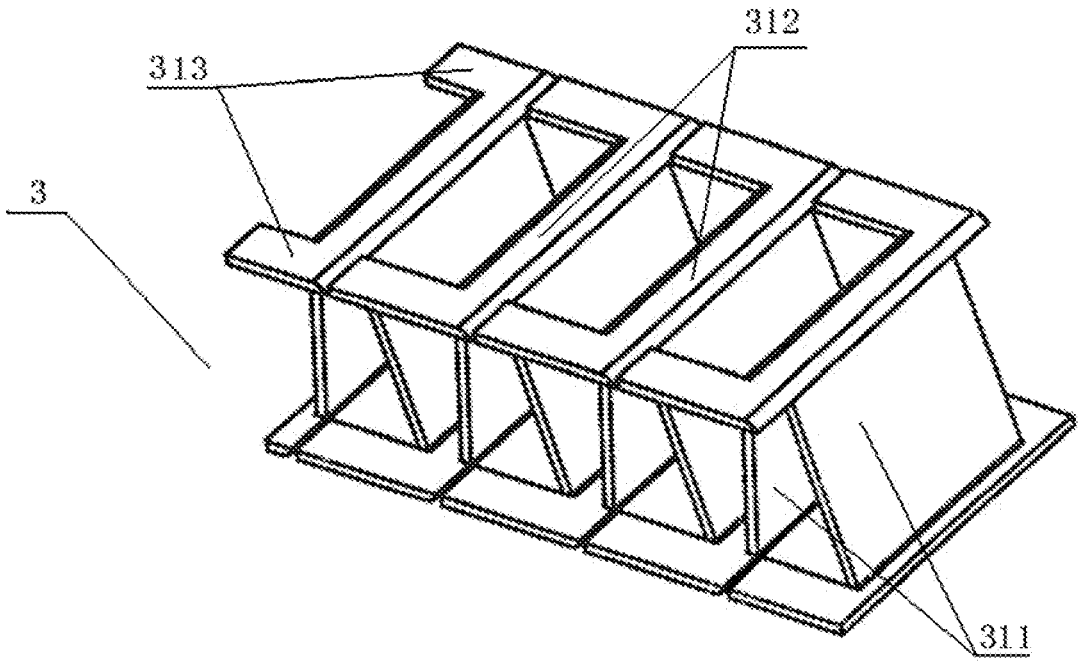

FIG. 5 Three dimensional schematic diagram of the heat sink structure.

Figure 6:
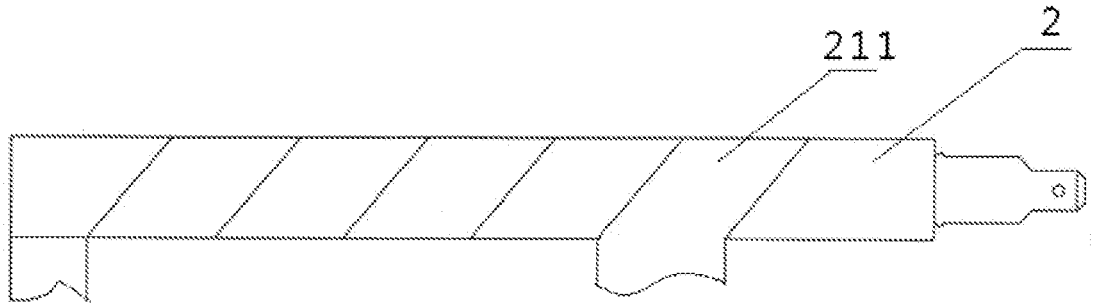

FIG. 6 Illustration of the insulating paper wound in a spiral manner on the PTC heating element.

Figure 7:
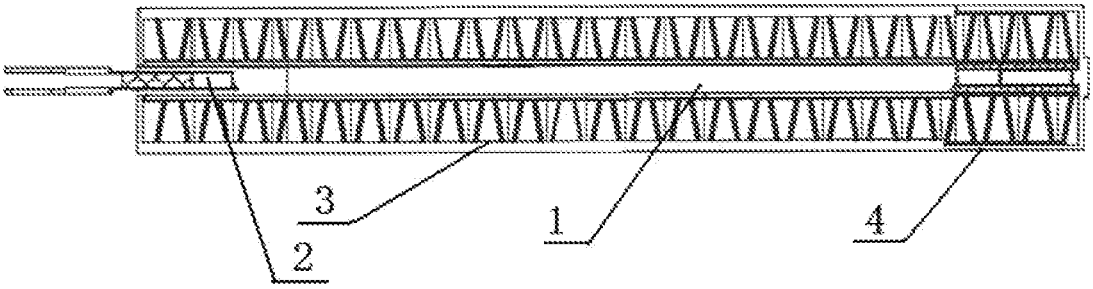

FIG. 7 Schematic diagram for the combination structure of the heater tube, heat sink, fastening metal sheet and the PTC heating element.

Figure 8:
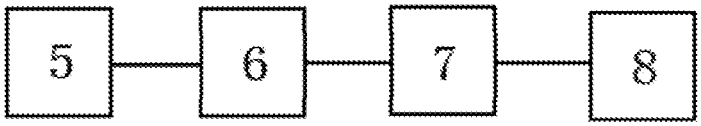

FIG. 8 Part of the circuit diagram of the present invention.

Figure 9:
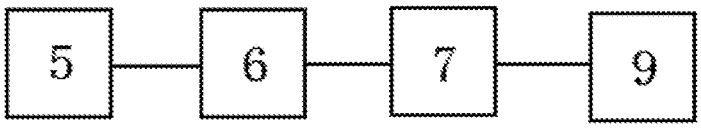

FIG. 9 Another part of the circuit diagram of the present invention.

Figure 10:
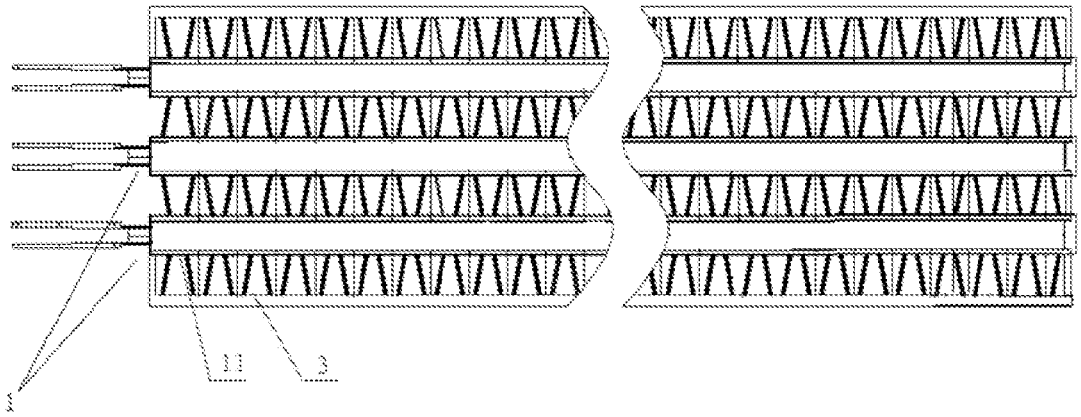

FIG. 10 Multi-row modular structure of the present invention.

DETAILED DESCRIPTION FOR IMPLEMENTING THE INVENTION

In order to clearly demonstrate the technical approach, the characteristics, the objectives and effectiveness of the present invention, we shall explain its implementation with assistance of specific figures.

Refer to FIG. 1, FIG. 2, FIG. 7, Crimping-fixed, remotely regulated electric heater include: a heater tube body 1 to hold the PTC heating element 2, heat spreading strip (heat sink) 3 attached to the heater tube 1. The heater tube 1 is a long strip-shaped metal tube; Flanging 11 is made on both sides of the left surface of this metal tube 1; Flanging 12 is made on both sides of the right surface of this metal tube; Grooves are made at the corner between these flangings and the upper/lower surface of the metal tube body; Inside the long-strip shaped metal tube body 1 is a cavity to hold the PTC heating element 2. Insulation layers 21 are applied in the cavity. The PTC heating element 2 heat the air inside the cavity. The insulation layer, composed of insulation paper, insulate the PTC heating element 2 from the long strip-shaped metal tube.

Flanges 11 and 12 are made on the left and right side surface of the strip-shaped long metal tube. While in use, heat sink 3 is attached to the upper and lower surface of the metal tube 1. The flanges 11, 12 are then bent and folded to hold the heat sink 3 on the metal tube 3. Compared to the adhesive method, it avoids the problem of producing glue smell and thus reduces chemical pollution and is more environmental friendly. Meanwhile, it avoids the aging-induced glue loosing problem, and thus prolongs its life time. Compared with traditional electric heater tubes, it is more suitable for small electric heaters, air conditioners, car heaters, air plane heaters, train heaters, marine heaters, etc. Especially, its advantages become more prominent when applied for indoor air conditioning.

Grooves are made at the corner between the flange and the electric heater tube. It facilities folding the flanges by rolling or stamping technique. While folding using rolling or stamping technology, since the groove material is thinner, it is easier to be bent, the folding is uniform and the connection is tighter. The cross section of the groove is arc-shaped, whose radius is in the range of 0.1~0.6 mm, preferably 0.2~0.4 mm. The use of arc-shaped grooves helps the connection between the heat sink 3 and the heater base 1 is tighter if using rolling or stamping technique.

The rolling or stamping equipment is equipped with a pressure sensor at the position where pressure is applied. The pressure transducer is connected to the control system that controls the rolling or stamping equipment. Pressure feedback is then obtained. The control system adjusts the pressure level based on the feedback, so that the pressing is accurate.

Refer to FIGS. 1 and 8, Temperature sensor 5 is instrumented on the heater surface 1. This temperature sensor is then connected to the inlet of a remote regulation network 6. When heater 1 is powered on, heat is generated in the PTC heating element, and is then transferred to the heater body 1. The temperature sensing device 5 measures the heater tube (1) temperature, and sends the temperature signal to the remote regulation network 6. One obtains the working condition of the remotely regulated heater. The remote regulation network 6 is connected to a power supply detection system 7, which is connected to the power input 8 of the electric heater 1. The power detection system 7 checks the power input 8, then sends the detection results to the remote regulation network 6. The remote regulation network is equipped with a signal processing module, which examines the data transferred from the power supply detection system, and decides whether the power input is on, if it is on, then controls the above mentioned temperature sensing device 5 to sense the temperature on the heater body 1. The temperature sensing device 5 senses the temperature and sends the results to the signal processing module. The module examines if the temperature is in the set range, if not, indicating the heater body 1 is working improperly. In the case of heating tube failure, air conditioner maintenance personnel are notified through the remote regulation network 6, timely maintenance is achieved.

Refer to FIGS. 1 and 9, the power supply detection system 7 can be connected to a heating control system 9 to control the heating of the electric heater 1. The power supply detection system 7 detects whether the heating control system is heating the electric heater 1, and send the results to the input of the remote regulation network 6. The remote regulation network 6 is equipped with a signal processing module, which determines if the heating control system 9 is working properly based on the transferred data. If the heating control system 9 is judged to be normal, the temperature sensing devices 5 are controlled to measure the body temperature of the electric heater 1. The temperature signal obtained is then sent to the signal processing module to determine if the temperature is outside the set range, and thus determine if there is failure on the electric heater 1. Under the situation of heater body failure, air conditioner maintenance personnel are notified via the remote regulation network, timely maintenance is achieved. The above mentioned devices are connected to the remote regulation network by using wireless LAN, Bluetooth or electronic label communications.

The distance between the left surface of the long strip-shaped metal tube body to its lower surface is between 10.0 mm~30.0 mm, preferred 12.0 mm~24.0 mm; the distance between the upper and lower surface of the metal tube is between 8.0 mm~20.0 mm, preferably 8.0 mm 15.0 mm. The wall thickness of the metal tube is between 0.5 mm~1.5 mm, preferably 0.6 mm 1.2 mm.

The PTC heating element 2 can be made from ceramic. Ceramic PTC heating element 2 is characterized with such advantages as fast heating, high thermal efficiency and low cost. The PTC heating element 2 can also be made from metal. Metallic PTC heating element 2 is characterized with such advantages as fasting heating, high thermal efficiency, good stability, no power attenuation, better overloading capability.

Refer to FIGS. 3, 4, 5 and 7, there are at least two heat spreading fin units 31 on each of the above mentioned heat sinks 3. Towards to its leading edge, near the central of the fin unit 31, a metal sheet 311 is bent to form a tilted angle with respect to the horizon. Towards its trailing edge is a horizontal metal sheet 312. The parts on both side of the tilted metal sheet 311 are kept horizontal and work as fastening sheet 313. The front of the tilted metal sheet 311 of the fin unit 31 is connected to the back of the horizontal metal sheet 312 of another fin unit 31. There are at least two fin units to form this structure. Two adjacent tilted metal sheets 311 are towards opposite directions. The length of the fastening metal sheet 313 is equal to the longest distance between two adjacent titled metal sheets 311. Another metal sheet 4 as a fixation covers the top surface of the heat sink 3. Flanges are made on both left and right sides of this metal sheet. The upper fastening metal sheet 313 is clamped to the fixation metal sheet 4 by the two flanges. The lower fastening metal sheet 313 is clamped to the heater tube 1 using the flanges 11, 12 on both sides of the tube body.

U-shaped aluminum sheet is used to make the fixation metal sheet 4 so that it could be fixed on the heat sink 31. On both sides of the tilted metal sheet 311 of the heat sink 31, two horizon metal sheets are firmly pressed to form two fastening metal sheets 313, so that the U-shaped aluminum plate can be folded and fixed. In the case when there are at least two pieces of metal heat sink 31 pressed together so that their tilted metal sheets 313 are horizontal and parallel, as long as a loner flange set is made on one side of the U-shaped metal plate, all of the fastening metal sheets 313 are fastened and fixed. Two flanges are used to obtain better fixation for the overall structure.

The length of the fastening metal sheet 313 is set to be equal to the longest distance between two adjacent tilted metal sheet 311, so that two adjacent fin units 31 are connected more tightly. The heat sink thus is stronger and the life time of air conditioners is prolonged. The lower fastening metal sheet 313 is used for clamping heat sinks 3 directly to the electric heater tube 1.

This invention uses rolling or stamping technique in the production process. A whole piece of metal sheet is rolled or stamped into various connected heat spreading metal fin unit 31. Each fin unit 31 is one unit of the heat sink 3 which can be seen from side as a number of ladder-shaped metal component. When the heater tube 1 is long, one can roll and stamp heat sink with appropriate length based on the heater tube 1 length, so that it fits the heater tube length perfectly. Therefore, the use of rolling or stamping technique to make heat sink is good for making heat sinks that match tube 1 length, and thus can be applied to various tube lengths. Meanwhile, better size precision, stronger connection, less lead are obtained using rolling and stamping. It is environmental friendly and ensures people's health.

The width of the fastening metal sheet 313 is equal to the half of the difference between the width of the horizontal metal sheet 312 and the width of the tilted metal sheet 311. The width of the horizontal metal sheet 312 is 11.0 mm~20.0 mm, preferably 15.0 mm. The width of the fastening metal sheet 313 is 1.0 mm~4.0 mm, preferably 2.0 mm. The length of the fastening metal sheet 313 is 1.0 mm~5.0 mm, preferably 3.8 mm. The angle between the horizontal metal sheet 312 and the tilted metal sheet 313 is 115 degrees to 125 degrees, preferably 120 degrees. The length of the horizontal metal sheet 312 is 1.0 mm~5.0 mm, preferably 2.2 mm. The height of the heat sink is 5.0 mm~15.0 mm, preferably 9.0 mm, so that maximum heat transfer efficiency is obtained. The heat sink is made from aluminum, which has good thermal conductivity and oxidation resistance. Thus, improved heat transfer efficiency and longer heat sink life of usage are obtained.

Refer to FIGS. 6 and 7, the PTC heating element 2 is wrapped with insulation layer 21, made from insulation paper 211 which is a long slender strip. The insulation paper 211 is wound in a spiral way on the PTC heating element 2. Adjacent insulation paper layers partially overlap. The insulating paper 211 is wound in a spiral manner on the PTC heating element 2. Because the winding is in the diagonal direction, the wrapping is tighter compared to the traditional winding method. It reduces the possibility of gap generation; makes it easier to put the PTC heating element 2 into the heater cavity 1. Thus, it avoids the noise problem that is resulted from loose winding, and prolongs the life time of electric heaters. The width of the insulation paper 211 is 20 mm~100 mm, preferably 41 mm, so that the insulation paper 211 can be easily wound on the PTC heating element 2.

The width of the insulation paper 211 overlapping section is 10 mm~50 mm. Spiral wound winding is used to make the wrapping tighter, reduce gap generation and reduce the noise generation during the heating process of the electric heater 1.

Because of the above technical approach, this invention makes it possible for the tight connection between the insulation paper 211 and the PTC heating element 2. With simpler structure, it is easier to install, reduces the possibility of generating noise due to the gap between insulation paper strip 211, and thus extend the life time of the electric heater.

FIG. 10 shows a multi-row modular structure based on the present invention. In practice, one can use at least one heater pipe body 1, and also can use 1 to 10 such units that are lined up layer by layer, from top to bottom.

The lower part of the heating tube 1 is clamped to the fastening metal sheet 313 of the heat sink on both sides, using its folded flanges 11 and 12. The heat sink 3 is thus firmly attached to the heater tube 1. On the other side, the upper heater tube 1 surface is closely clamped to the top fastening metal sheet 313 of the heat sink, on its both sides, using its folded flanges 11 and 12. And so constitute a multi-row modular structure, to provide heating together and thus improve the heating capacity, which is suitable for occasions that require high heat.

We have demonstrated the basic principle and features of this invention, as well as its advantages. Professionals in this are understand, the application of this invention is not just limited to the given examples, where are used to explain the basic principles of this invention. Following the same idea and logic, one can improve or make variation of this invention. These improvements or variations are in the patent protection scope. This invention thus requires the scope of protection to be defined in the following patent claim section.

I claim:

1. A crimping-fixed, remotely regulated electric heater comprising:

a heater tube body to hold a plurality of PTC heating elements and a heat sink that is attached to the heater tube body;

said heater tube body having a long strip-shaped metal tube and both a left side and a right sides of said long strip-shaped metal tube having a flange attached, the corners of tube body between said flanges and a top and a bottom outside surfaces of said long strip-shaped metal tube having a plurality of grooves, and an inside of said long strip-shaped metal tube body having a cavity to hold PTC heating elements wherein an insulation layer is applied in said cavity to prevent said heating elements directly contacting said tube body;

said heat sink having at least two heat spreading fin units; wherein said fin unit towards a leading edge is bent upward at its central portion to form a tilted metal sheet and towards a trailing edge, said fin unit is kept in horizontal position to form a horizontal metal sheet and said fin units on both sides of said tilted metal sheet are kept horizontal to form two fastening metal sheets;

a front side of a tilted metal sheet of a fin unit being connected to a back side of the horizontal metal sheet of another fin unit, wherein at least two fin units are connected in sequence to form a heat sink structure; and two adjacent tilted metal sheets being pointed toward to opposite directions and the longest distance between two adjacent titled metal sheets is equal to the length of a fastening metal sheet formed in said heat sink structure wherein the lower fastening metal sheet is clamped to said heat tube body using said flanges on both sides of the tube body.

2. The crimping-fixed, remotely regulated electric heater defined in claim 1, wherein the width of said fastening metal sheet in said heat sink structure is equal to the half of the difference between the width of said horizontal metal sheet and the width of said tilted metal sheet in said heat sink structure;

a fixation metal sheet as a fixation covers the top surface of said heat sink and flanges both a left and a right sides of said fixation metal sheet having flanges; and the upper fastening metal sheet being clamped to the fixation metal sheet by these two flanges.

3. The crimping-fixed, remotely regulated electric heater defined in claim 1, wherein said PTC heating element is wrapped in a spiral manner with an insulation paper which is a long slender strip and adjacent insulation papers partially overlap.

4. The crimping-fixed, remotely regulated electric heater defined in claim 2, wherein the grooves are made at the corners formed between said flange and a top and a bottom outside surfaces of said heater tube body, wherein the cross section of said grooves are arc-shaped.

5. The crimping-fixed, remotely regulated electric heater defined in claim 3, wherein the inside of said heater tube body is a cavity which holds the said PTC heating element for heating purpose.

6. The crimping-fixed electric heater defined in claim 5 that is regulated remotely via a network, wherein said heater tube body has a temperature sensing device connected to the inlet of said remote regulation network, and when said heater tube body is powered on, heat being generated in the PTC heating element, and transferred to the heater tube body; and said temperature sensing device monitoring said heater tube body's temperature, and sending out the temperature related signal of said beater body via said network.

7. The crimping-fixed, remotely regulated electric heater defined in claim 6, wherein the said remote network is connected to a power supply detection system that is connected to a power input of said heater tube body and said power supply detection system checks the input received from the power input, then sends the detection results to said remote network; wherein said remote network is equipped with a signal processing module, which examines the data transferred from the power supply detection system, and decides whether the power input is on, then controls the said temperature sensing device senses the temperature of said heater tube body and sends the results to the signal processing module; wherein the signal processing module monitoring if the temperature is working within a predetermined range, if not, sending alarm through said remote network to get proper responses accordingly.

8. The crimping-fixed, remotely regulated electric heater defined in claim 6, wherein said PTC heating element is made from ceramic;

said power supply detection system connected to a heating control system to control the heating of said heater tube body and said power supply detection system detecting whether said heating control system is powered to heat said heater tube body, and sending a transmitting data to the input of said remote network; wherein said remote network is equipped with a signal processing module to monitor and determine if said heating control system is working properly based on the transferred data, otherwise alarming through said remote network, a proper action can be taken accordingly.

9. The crimping-fixed, remotely regulated electric heater defined in claim 5, wherein said remote network is accessed by using a wireless local area network (LAN) communication and said PTC heating element is made from metal.

10. The crimping-fixed, remotely regulated electric heater defined in claim 5, wherein said remote network is accessed by using electronic label communication and said heat sink that is a whole piece of metal sheet is rolled or stamped into various connected heat spreading metal fin units, and each fin unit is the smallest unit of the heat sink which can be seen from side as a number of ladder-shaped metal components.

* * * * *